United States Patent [19]

Click

[11] 4,279,738

[45] Jul. 21, 1981

[54] METHOD AND APPARATUS FOR THE RECOVERY OF REFINED PETROLEUM PRODUCTS FROM PIPELINE MIXTURES

[76] Inventor: Robert F. Click, 8035 S. 79th E. Ave., Tulsa, Okla. 74133

[21] Appl. No.: 126,034

[22] Filed: Feb. 29, 1980

[51] Int. Cl.[3] ..... C10G 29/04; C10G 25/00; C10G 7/00

[52] U.S. Cl. ..... 208/253; 208/301; 208/349

[58] Field of Search ..... 208/349, 253, 294, 184, 208/186, 299, 301, 251 R

[56] References Cited

U.S. PATENT DOCUMENTS

| | | | |
|---|---|---|---|
| 2,897,131 | 7/1959 | Berger | 208/253 |
| 3,893,912 | 7/1975 | Zimmerman | 208/253 |
| 3,923,643 | 12/1975 | Lewis | 208/251 R |

*Primary Examiner*—T. M. Tufariello
*Attorney, Agent, or Firm*—William S. Dorman

[57] ABSTRACT

A method of recovering petroleum products from an interface mixture containing a low boiling gasoline having lead components, a medium boiling aviation fuel, and a high boiling residual petroleum product comprising the steps of preheating a fluid stream containing the interface mixture, introducing the fluid stream into a first fractionation tower operating at a first temperature below the degrading point of the lead components and below the initial boiling point of the aviation fuel; recovering the majority of the gasoline and a major quantity of the lead components as a first overhead product stream from the first tower, recovering a minor fraction of the gasoline along with a minor quantity of the lead components; in addition to the aviation fuel and the residual petroleum product, as a first bottoms stream from the first tower; introducing the bottoms stream into a bottom-fed reactor vessel having a catalyst bed containing a catalyst capable of chemically adsorbing the lead components while the first bottoms stream is liquid; withdrawing a second overhead stream from the top of the reactor vessel and heating the same to a second temperature near the initial boiling point of the aviation fuel; and introducing the heated second overhead stream into a second fractionation tower wherein the remaining gasoline and a small fraction of the aviation fuel are carried off as overhead products, recovering the residual petroleum product as a second bottoms stream, and recovering the remaining fraction of aviation fuel as an intermediate side stream.

8 Claims, 2 Drawing Figures

METHOD AND APPARATUS FOR THE RECOVERY OF REFINED PETROLEUM PRODUCTS FROM PIPELINE MIXTURES

BACKGROUND OF THE INVENTION

1. Field of the Invention

The present invention relates to a method and an apparatus for the recovery of refined petroleum pipeline products from various interface mixtures, more particularly removing tetraethyl or tetramethyl lead from jet fuels and fuel oils by means of a catalytic convertor which is operated in the liquid phase.

2. Prior Art

Refined petroleum products are often transported through interstate pipeline systems in "batched runs". A batched run comprises a plurality of refined products separated by "pigs" or spheres which travel through the pipeline. However, some mixing of the fluids cannot be avoided and a portion of the fluid before and after each pig must be taken off as an interface mixture. This interface mixture of the refined products is commonly referred to as "slop".

It has been the general practice in the prior art to mix this slop with crude oil to be re-refined. The prior art does not teach or suggest any system such as that disclosed herein for recovering refined petroleum products from "slop".

Catalytic converters are well known in the prior art; however, no prior art reference discloses a catalytic convertor operated in a liquid phase which adsorbs tetraethyl or tetramethyl lead components contaminating certain refined products such as jet fuels.

SUMMARY OF THE INVENTION

The present invention provides a method and an apparatus to recover a large portion of refined products from the slop normally encountered in interstate product pipeline systems. Currently the interface mixture, consisting of refined products such as fuel oils, aviation fuel and gasolines for automotive use, are auctioned to small refiners at a large cost penalty to the transporter. This is particularly true of product pipeline systems transporting leaded gasolines or other gasolines containing anti-knock additives or additives used to raise the octane rating of the gasoline. The lead contamination violates normal ASTM (American Society for Testing Materials) designation for aviation fuels and fuel oils. Additionally, the heavy ends of the petroleum hydrocarbons from one fuel or product will contaminate adjacent batched products.

It should be noted that the present invention is not necessarily a method to meet the full ASTM product specifications, rather an economical method to recover a blendable product stock which can be reinjected into a storage tank or pipeline without upsetting the product quality.

For example, a tertiary mix containing regular gasoline for automotive use, jet "A" fuel, and No. 2 fuel oil is processed through the apparatus of the present invention. However, the present invention is not limited to the above mix.

The following comprises the steps of processing a fluid stream of the interface mixture or slop through the present invention:

A feed charge is first filtered for the removal of free water and particulate material and is then sent to a preheater to bring the fluid up to an initial system temperature.

The fluid stream flows through a first fractionation tower wherein the top of the tower is maintained at a temperature below the initial boiling point of the jet fuel and below the degrading temperature of the lead components of the gasoline. The majority of the gasoline as well as most of the tetraethyl lead are split from the jet fuel and the fuel oil in the first tower and are carried off as overhead.

The overall distribution of the tetraethyl lead is greatly reduced in the bottoms of the first tower, however, the remaining lead (and gasoline) may be selective to the higher (lighter) ends of the jet fuel. The preceding observation is consistent with the aspect that the end point of the gasoline is higher than the initial boiling point of the jet fuel.

The stream from the bottoms of the first tower is heated to a temperature just below the initial boiling point of the tetraethyl lead so that the lead and gasoline remain a liquid and the lead does not degrade prior to entering a reactor vessel.

The reactor is a bottom-fed vessel containing a catalyst of either a platinum-palladium blend or a nickel-tungsten blend on silica or alumina beads. The spent catalyst remains on the bottom of the vessel for safer removal of the poisoned catalyst material. The bottoms stream passes through the reactor vessel and the tetraethyl lead reacts and is chemically adsorbed on the catalyst bed. The catalyst should reduce the lead present to approximately five parts per million which is well within the range allowed by ASTM for jet fuels.

The overhead stream coming off the top of the reactor vessel is heated to a temperature near the initial boiling point of the jet fuel and is then fed into a second fractionation tower. The purpose of the second tower is to remove any remaining gasoline from the jet fuel and to separate the remaining jet fuel fraction from the fuel oil. The remaining portion of the gasoline as well as a small portion of the jet fuel are carred off as overhead products from the second tower. A portion of the overhead products is condensed and flashed to maximize the jet fuel recovery.

The jet fuel and fuel oil are taken from the second tower in a semi-binary fractionation allowing the residual or heavy ends of the petroleum hydrocarbons to go to the fuel oil. A reboiler is employed to assist in the separation.

The separated streams of each of the refined products are taken to individual stabilizers wherein a portion of the overhead stream from the jet fuel and the fuel oil stabilizers are recycled into the second fractionation tower. The overhead from the gasoline stabilizer is segregated and cooled and is then sent to slop to avoid possible tetraethyl lead contamination. The bottoms of each stabilizer are then cooled and moved to storage.

DETAILED DESCRIPTION OF THE PREFERRED EMBODIMENTS

The present invention relates to a method and an apparatus for the recovery of refined petroleum products from various interface mixtures generated during pipeline transit. The process of the present invention is based on a variation of the conventional principles of "heart-cut" fractionation and the key of selective catalytic reaction while the bulk of the fluid is in the liquid phase.

A feed charge 4 of an interface mixture comprising, for example, a low boiling gasoline having tetraethyl (or tetramethyl) lead components, a medium boiling jet fuel, and a high boiling residual fuel oil is filtered to remove free water and particulate material prior to entering the system of the present invention. As a specific example, feed charge 4 can be comprised of 65% jet fuel "A", 25% leaded gasoline, and 10% No. 2 fuel oil, wherein the jet fuel is considered the most valuable product. However, the selection of the aforementioned mixture is provided for the purpose of reference only, and various interface mixtures comprising propane, butane, unleaded gasolines, diesel and other products, wherein the lead content is strictly controlled, may be processed through the apparatus of the present invention. The key of the present invention is a selective catalytic reaction wherein contaminating lead components are chemically adsorbed on the catalyst bed.

Figure 1:
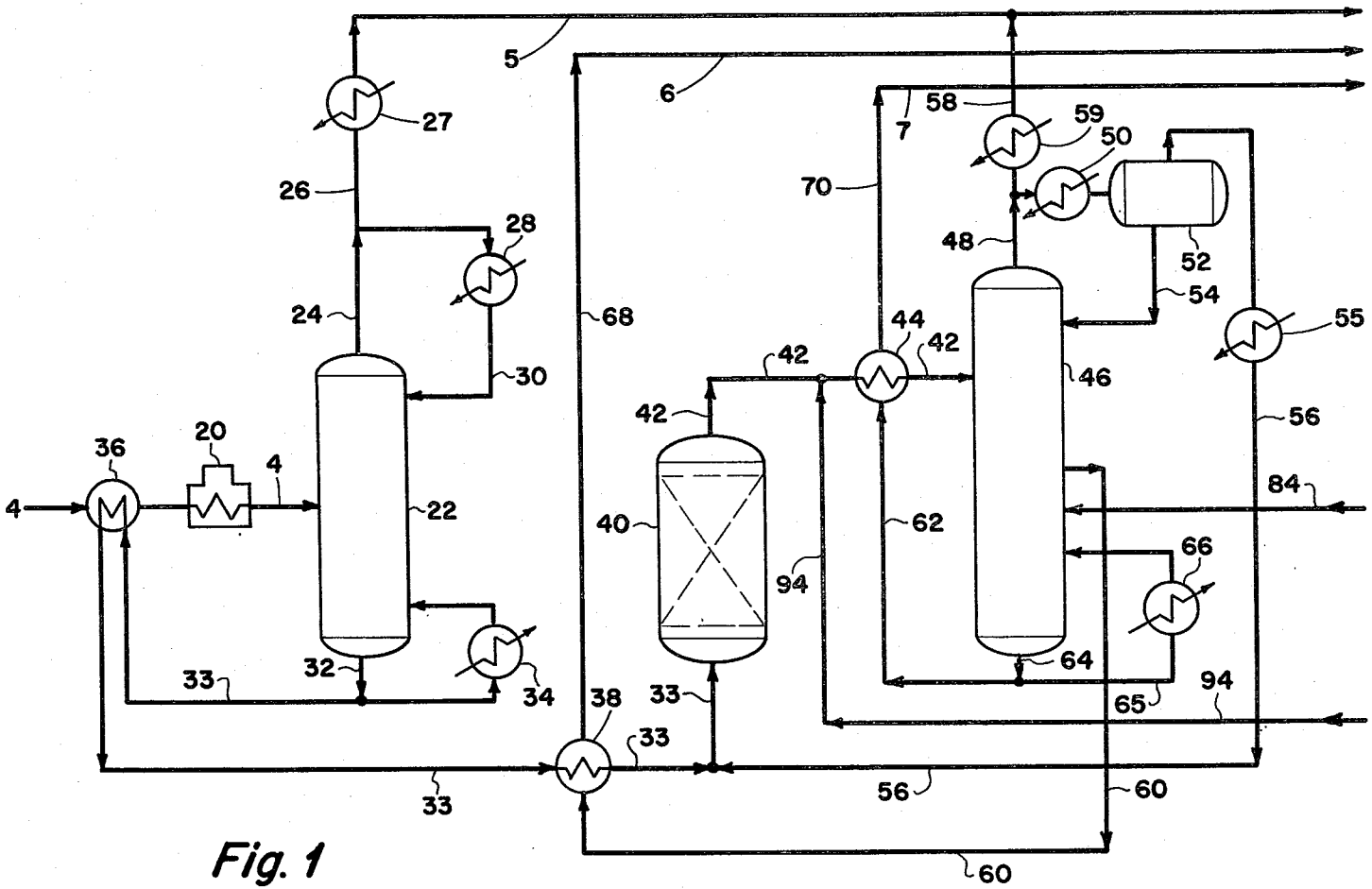
FIG. 1 is a schematic drawing showing the initial treatment of a fluid stream through a first stage fractionation tower, a reactor vessel, and a second stage fractionation tower in accordance with the present invention.

Referring to FIG. 1, charge 4 is fed into a preheater 20. The initial temperature of charge 4 is approximately 18° C. on the average. Pre-heater 20, which is employed as a start-up heater, brings charge 4 up to an initial system temperature of approximately 160° C. The preheater, which is on thermostatic control (not shown), can be used later as a supplemental heater to maintain a constant system temperature.

Charge 4 is fed into a first stage fractionation tower 22. First tower 22 operates at an average approximate temperature of 185° C. and pressure of 150 p.s.i. wherein approximately 90% of the gasoline as well as approximately 99% of the tetraethyl lead are split as overhead 24 from the jet fuel and fuel oil. The tetraethyl lead has a degrading temperature of 200° C., therefore the top of tower 22 must be maintained below the limiting temperature of 200° C. The top of the tower should stay at a temperature as high as possible on the boiling curve of gasoline, which has an initial boiling point of 185° C. and an end point of 225° C., yet remain below the initial boiling point of the jet fuel of approximately 204° C.

Most of the tetraethyl lead component, along with the majority of the gasoline, goes off in an overhead product stream 26. Overhead product stream 26 feeds into a condenser 27 which cools the vapor overheads to a liquid and is then fed into a main gasoline recovery stream 5. As is common in most fractionation towers, some of the overhead 24 is run through a condenser 28 and is then recycled into tower 22 as reflux 30. Some of the bottoms 32 from tower 22 will be sent to a reboiler 34 to be recycled into tower 22. Reboiler 34 also provides a means for heating the first tower and is commonly gas-fired.

As shown, a portion of bottoms stream 33 at an approximate temperature of 185° C. from tower 22 is run through a heat exchanger 36, thereby heating any subsequent feed charge 4 entering the system. After the initial start-up, heat exchanger 36 should be sufficient to meet the pre-heating requirements for any subsequent feed charge without the use of preheater 20.

Bottoms stream 33 at lowered temperature of 38° C. is fed into another heat exchanger 38, to be described hereinafter, is preheated to approximately 88° C., and is then fed into a bottom-fed reactor vessel 40 operating at a pressure between 100 p.s.i. and 150 p.s.i. Reactor vessel 40 is provided with a catalyst bed (not shown). The design of the reactor vessel, not herein disclosed, allows new catalyst material to be introduced through the top of reactor vessel 40 while providing a means of bottom-dumping the used material. This design avoids most of the potential hazards to personnel which might come in contact with the poisoned catalyst.

The catalyst is of a type, such as a platinum-palladium or a nickel-tungsten blend preferably on silica beads or pellets, employed to reduce the tetraethyl lead present to acceptable standard while operating in the liquid phase. As the bottoms stream 33 passes through the catalyst bed, the tetraethyl lead reacts and is chemically adsorbed on the catalyst bed, which is therefore intentionally poisoned. The tetraethyl lead is kept below its initial boiling point of approximately 91° C. prior to entering the reactor to avoid vaporizing some of the residual gasoline and to maintain the charge temperature to the reactor at a true liquid phase. The charge temperature is critical, in that, it avoids decomposition of the tetraethyl lead which causes accidental inhibition of the reaction. The tetraethyl lead reaction with the catalyst is slightly exothermic and will drive the tetraethyl lead past its initial boiling point and thus assist in the local reaction on the catalyst surface. The process in reactor vessel will reduce the tetraethyl lead present to within the range of five parts per million as allowed by ASTM for jet fuels.

An overhead fluid stream 42 flows out of the top of vessel 40 at an approximate temperature of 93° C. through a heat exchanger 44 in which stream 42 is preheated (as will be explained hereinafter) to near the initial boiling point of the jet fuel (204° C.) and is subsequently fed into a second stage fractionation tower 46 operating at a pressure of 100 p.s.i. The remaining fraction of gasoline as well as approximately 10% of the jet fuel are carried from the top of tower 46 (238° C.) as overhead 48. The majority of overhead 48 is run through a partial condenser 50 and a flask tank 52 to maximize jet fuel recovery. Some of the overhead 48 is returned from flash tank 52 to second tower 46 as reflux 54 (226° C.) thus maintaining the upper tower temperature, whereas the flashed portion 56 is returned to the bottom of the reactor vessel as shown. The flashed portion 56 can be fed into an optional condenser 55 (as shown), to be used as desired whenever the vapor improperly mixes with the bottoms stream 33 prior to entering reactor vessel 40. A minor portion of overhead 48 containing the remaining gasoline fraction and a small supplemental jet fuel fraction goes into a condenser 59, cooling the vapor into a liquid which is fed by a line 58 to join into gasoline stream 5.

Two slip streams from second tower 46 are used in the preheating. A first slip stream 60, coming off as an intermediate stream from the second tower at an approximate temperature of 245° C., returns to heat exchanger 38 to preheat bottoms stream 33 prior to entry into reactor vessel 40. A second slip stream 62, coming off a portion of the bottoms 64 from second tower 46 at an approximate temperature of 275° C., is the second stage fractionation tower. Second tower 46 is provided with a side stream reboiler 66 which recycles another stream portion 65 of bottoms 64 into the second tower. Reboiler 66 provides the means for heating the second tower and is also generally gas-fired.

Jet fuel and fuel oil, in previously described slip stream 60 and 62, respectively, are taken from the second tower as a semi-binary fractionation wherein the residual heavy ends of the petroleum hydrocarbons tend to go to the fuel oil. The jet fuel is carried off in a line 68, which is a continuation of slip stream 60, to join into a main jet fuel recovery stream 6. The fuel oil is carried off in a line 70, which is continuation of slip stream 62, to join into a main fuel oil recovery stream 7. Second stage fractionation tower 46 should provide a 98-99% split in the remaining fractions of jet fuel and fuel oil, the only remaining problems being those of color and stability.

Figure 2:
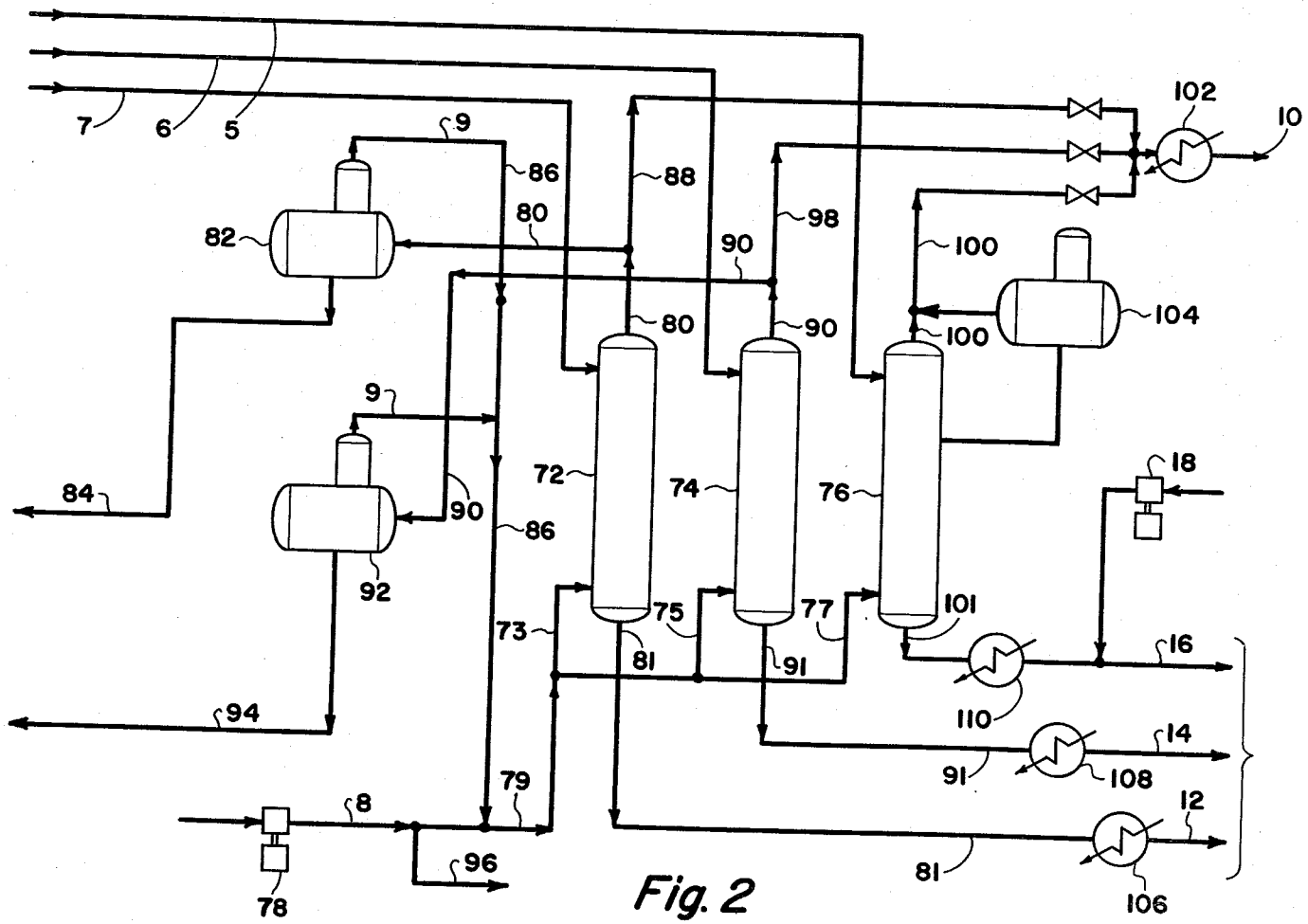
FIG. 2 is a schematic drawing representing a continuation of FIG. 1 showing the subsequent treatment through stabilizers and separators in accordance with the present invention.

Referring to FIG. 2, each stream 5, 6, and 7 are taken to separate stabilizing columns operating at approximate temperature and pressure of 42° C. and 30 p.s.i. respectively; that is, a stabilizer 72 is provided for fuel oil stream 7, a stabilizer 74 is provided for jet fuel stream 6, and a stabilizer 76 is provided for gasoline stream 5. An optional connection 78 containing a hydrogen-rich gas 8 can be provided for stripping to improve color as well as reduce existant gum tendencies. The hydrogen-rich gas is fed into stabilizers 72, 74, and 76 by means of lines 73, 75, and 77, respectively, which connect with a common gas inlet line 79. The hydrogen-rich gas is bubbled up through the stabilizers which causes an incidental vaporization of the lighter ends of the petroleum products. As the bubbles of the gas 8 come out as overhead from the stabilizers, the bubbles have a liquid film around them containing the lighter ends of the products.

A portion of the overhead from fuel oil stabilizer 72 is taken to a flash tank or separator 82 and is subsequently recycled into second stage fractionation tower 46 by means of a feed line 84 (see FIG. 1). A portion of the overhead 90 from jet fuel stabilizer 74 is taken to a flash tank or separator 92. The heavier ends of the jet fuel are taken from flash tank 92, by means of a feed line 94 (see FIG. 1) and are fed into the line containing overhead stream 42 just prior to entering heat exchanger 44 and the second tower.

The lighter ends of the fuel oil and the jet fuel are cooled in flash tanks 82 and 92, respectively, so that the majority of hydrogen-rich gas 8 will be broken out. The broken-out gas, designated by reference numeral 9, is returned to the hydrogen gas line 79 by means of a line 86 to be re-fed into the stabilizers. Any excess hydrogen-rich gas that may accumulate in the system is taken into a fuel gas line 96. This fuel gas can be used to power the reboilers 34 and 66. During this stage, the tetraethyl lead present in the fuel oil and the jet fuel is well below five parts per million, therefore the lead contamination of the fuel gas is minimal.

The overhead 100 from gasoline stabilizer 76 is segregated, cooled by a condenser 102 and sent to slop 10, because of possible lead contamination to the fuel gas. An optional overhead reflux vessel 104 may be employed if overhead 100 gets excessive. Suitable valves (not shown) can be employed to cut the reflux vessel out of the system, as desired.

The bottoms 81, 91, and 101 from each stabilizer are cooled by condensers 106, 108, and 110, respectively, and sent to individual storage by means of a fuel oil storage stream 12, a jet fuel storage stream 14 and a gasoline storage stream 16, respectively. A tetraethyl lead make-up 18 may feed into gasoline storage stream 16, if required, in order to meet blending stock specifications.

Some waste will occur due to the crossing of end points and initial boiling points. As shown, the wastes of fuel oil and jet fuel are carried off from overhead 80 and 90 by lines 88 and 98, respectively. These wastes can be cooled by condenser 102 and sent to slop 10. The penalty slop 10 can be sold to a small refinery for blending with other stocks, particularly crudes.

The above process of the present invention does not necessarily provide a method to meet full ASTM products specifications, but rather an economical method approach to make blendable product stocks. The blendable products stocks 12, 14, and 16 can be reinjected into a storage tank or pipeline as desired without upsetting the product quality.

Whereas the present invention has been described in particular relation to the drawings attached hereto, it should be understood that other and further modifications, apart from those shown suggested herein, may be made within the spirit and scope of this invention.

What is claimed is:

1. A method of recovering refined petroleum products from an interface pipeline mixture containing a low boiling gasoline having tetraethyl and tetramethyl lead components, a medium boiling aviation fuel, and a high boiling residual petroleum product comprising the steps of first preheating a fluid stream containing said interface mixture, introducing said fluid stream into a first fractionation tower operating at a first temperature below the degrading point of the lead components and below the initial boiling point of said aviation fuel, separating the majority of said gasoline and a major quantity of said lead components from said fluid stream in said first tower, recovering said majority of gasoline along with said major quantity of said lead components as a first overhead stream from said first tower leading into a main gasoline recovery stream, recovering as a first bottoms stream from said first tower a minor fraction of said gasoline along with a minor quantity of said lead components in addition to said aviation fuel and said residual petroleum product, introducing said first bottoms stream into a bottom-fed reactor vessel having a catalyst bed, said catalyst bed containing a catalyst of the type capable of chemically adsorbing said lead components on its surface while said first bottoms stream is in a liquid state and at a temperature not exceeding the initial boiling point of said lead components, withdrawing a second overhead stream from the top of said reactor vessel and heating the same to a second temperature near said initial boiling of said aviation fuel, introducing the heated second overhead stream into a second fractionation tower wherein said minor fraction of gasoline and a small fraction of said aviation fuel are carried off as overhead products from said main gasoline recovery stream, recovering said residual petroleum product as a second bottoms stream from said second tower, and then recovering the remaining fraction of said aviation fuel as an intermediate side stream from said second tower.

2. A method as set forth in claim 1 wherein said preheating of said interface mixture comprises passing said first bottoms stream into a first heat exchanger prior to introducing said first bottoms stream into said reactor vessel, wherein said first bottoms stream is in indirect heat exchange relation with said interface mixture in said heat exchanger, thereby preheating said interface mixture and cooling said first bottoms stream.

3. A method as set forth in claim 1 and being further characterized by passing said intermediate side stream containing said remaining aviation fuel fraction through a second heat exchanger, passing said first bottoms stream through said second exchanger so as to be in indirect contact with said intermediate side stream thereby heating said first bottoms stream to a temperature not exceeding said boiling point of said lead components immediately prior to introducing said first bottoms stream into said reactor vessel and then introducing said first bottoms stream into said reactor vessel and then introducing said intermediate side stream into a mean aviation fuel recovery stream.

4. A method as set forth in claim 3 and being further characterized by passing said main aviation fuel recovery stream downwardly through a first stabilizer, passing a hydrogen-rich gas upwardly through said first stabilizer, withdrawing a first stabilizer overhead containing said hydrogen-rich gas and a portion of the lighter ends of said aviation fuel from said first stabilizer, and then introducing said first stabilizer overhead into a first separator wherein the hydrogen-rich gas is discharged into a gas recovery line and said portion of the lighter ends of said aviation fuel is discharged into said second overhead stream prior to entering said second tower.

5. A method as set forth in claim 1 and being further characterized by passing said second bottoms stream containing said residual petroleum product through a third heat exchanger, passing said second overhead stream through said third heat exchanger wherein said second overhead stream is in indirect contact with said second bottoms stream thereby heating said second overhead stream to a second temperature prior to introducing said second overhead stream into said second tower and then introducing said second bottoms stream into a main residual petroleum product recovery stream.

6. A method as set forth in claim 5 and being further characterized by passing said main residual petroleum product recovery stream downwardly through a second stabilizer, passing a hydrogen-rich gas upwardly through said second stabilizer, withdrawing a second stabilizer overhead containing said hydrogen-rich gas and a portion of the lighter ends of said residual petroleum product from said second stabilizer, and then introducing said second stabilizer overhead into a second separator wherein the hydrogen-rich gas is discharged into a gas recovery line and said portion of the lighter ends of said residual petroleum product is discharged into said second tower.

7. A method as set forth in claim 1 and being further characterized by said catalyst comprising a platinum-palladium blend on silica beads.

8. A method as set forth in claim 1 and being further characterized directing a major quantity of the overhead products from said second tower into a partial condenser and subsequently into a flash tank portion to said overhead products being carried off into said main gasoline recovery stream wherein the flashed portion of said overhead products is introduced into a line entering said reactor vessel.

* * * * *